US009082363B2

(12) United States Patent
Chang et al.

(10) Patent No.: US 9,082,363 B2
(45) Date of Patent: Jul. 14, 2015

(54) DRIVING DEVICE AND DISPLAY DEVICE AND METHOD FOR DRIVING DISPLAY PANEL

(71) Applicant: AU Optronics Corporation, Hsin-Chu (TW)

(72) Inventors: Meng-Sheng Chang, Hsin-Chu (TW); Shih-Chieh Kuo, Hsin-Chu (TW); Hung-Min Shih, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 201 days.

(21) Appl. No.: 13/833,175

(22) Filed: Mar. 15, 2013

(65) Prior Publication Data

US 2014/0104260 A1 Apr. 17, 2014

(30) Foreign Application Priority Data

Oct. 17, 2012 (TW) ..... 101138289 A

(51) Int. Cl.
*G09G 5/00* (2006.01)
*G09G 3/36* (2006.01)

(52) U.S. Cl.
CPC ..... *G09G 3/3685* (2013.01); *G09G 3/3607* (2013.01); *G09G 3/3614* (2013.01); *G09G 3/3688* (2013.01); *G09G 2330/023* (2013.01)

(58) Field of Classification Search
None
See application file for complete search history.

(56) References Cited

U.S. PATENT DOCUMENTS

| | | | | |
|---|---|---|---|---|
| 2006/0262069 | A1 | 11/2006 | Do et al. | |
| 2009/0174649 | A1 * | 7/2009 | Kim | 345/104 |
| 2009/0207118 | A1 | 8/2009 | Lee et al. | |
| 2011/0248985 | A1 | 10/2011 | Lin et al. | |
| 2012/0154358 | A1 | 6/2012 | Chen et al. | |

FOREIGN PATENT DOCUMENTS

| | | |
|---|---|---|
| CN | 101866590 | 10/2010 |
| CN | 102136244 | 7/2011 |
| TW | I295793 | 4/2008 |
| TW | 200830240 | 7/2008 |

* cited by examiner

*Primary Examiner* — Adam R Giesy
(74) *Attorney, Agent, or Firm* — WPAT, PC; Justin King

(57) ABSTRACT

A driving device is configured for driving a display panel and includes a data driver, a plurality of switches, and an image determiner. The switch is electrically coupled between data lines of a first data line group. The data driver is configured to output data signals to the data lines of the first data line group. The data signals transferred by the data lines of the first data line group include a plurality of pulse transitions while the display panel displays an image. The image determiner is configured to determine the image displayed by the display panel and output a driving signal based on a determined result for activating a corresponding switch such that the data lines of the first data line group can perform charge sharing therebetween. Furthermore, a method for driving a display panel is disclosed herein.

19 Claims, 6 Drawing Sheets

DRIVING DEVICE AND DISPLAY DEVICE AND METHOD FOR DRIVING DISPLAY PANEL

RELATED APPLICATIONS

This application claims priority to Taiwan Application Serial Number 101138289, filed Oct. 17, 2012, which is herein incorporated by reference.

BACKGROUND

1. Technical Field

The disclosure relates generally to a driving device and a method and, more particularly, to a driving device for driving a display panel and a method for driving a display panel.

2. Description of Related Art

Liquid crystal displays (LCDs) are used as display devices because they are able to render high-quality images with minimal driving power. In LCDs, the rod-like and planar-like, flat liquid crystal (LC) molecules are aligned in a specific orientation. The alignment of LC molecules in LC cells of the LC panel is important in determining the light transmittance.

The light-transmitting characteristics of LC molecules are changed by the application of a high voltage to an LC layer. If such changes were to become permanent, they would result in irreversible degradation of the display quality of the LC display panel. To avoid such degradation, the voltage signals provided to the LC cells should be changed constantly. In most cases, a source driver is disposed according to polarity inversion (such as, frame inversion, row inversion, column inversion, dot inversion and 2-line inversion) to generate voltage signals with alternating polarities.

An LCD display with a zigzag disposition can adopt column inversion. With such a structure, the power consumption of the LCD display is low when the LCD display displays white or black images. However, the pulse transition phenomenon is encountered when the LCD display displays other color images, which leads to increased power consumption of the LCD display.

Many in the related field have endeavored to find a solution to the aforementioned problems. Nonetheless, there is still a need to improve existing apparatuses and techniques in the art.

SUMMARY

One aspect of an embodiment is to provide a driving device for driving a display panel. The display panel comprises a plurality of pixels and a plurality of data lines, and each of the pixels comprises a plurality of sub-pixels. The sub-pixels are disposed in a sub-pixel matrix, and the data lines are electrically connected to the sub-pixels respectively.

Furthermore, the driving device comprises a data driver, a plurality of switches, and an image determiner. The data driver is configured to output a data signal to each of the data lines of a first data line group, and the data signals transferred by the data lines of the first data line group have a plurality of pulse transitions when the display panel displays an image. A plurality of switches are electrically connected between the data lines of the first data line group. The image determiner is configured to determine the image displayed by the display panel and to output a driving signal according to a determined result for activating the corresponding switches such that the data lines of the first data line group perform charge sharing therebetween.

In another aspect of the embodiment, a display device is provided. The display device comprises a display panel and a driving device. Furthermore, the display panel comprises a plurality of pixels, a first data line, a second data line, a third data line, a fourth data line, a fifth data line, a sixth data line. Each of the pixels comprises a plurality of sub-pixels. The data lines are disposed sequentially and electrically connected to the sub-pixels respectively, and the driving lines are disposed sequentially. In addition, the driving device comprises a data driver, a first driving line, a second driving line and a third driving line, a first switch, a second switch, a third switch, a fourth switch, a fifth switch and a sixth switch, and an image determiner. Moreover, each of the switches comprises a first terminal, a second terminal and a control terminal.

The data driver is configured to output a data signal to each of the data lines of the first data line group, and the data signals of the data lines of the first data line group have a plurality of pulse transitions when the display panel displays an image. The first terminal and the second terminal of each of the switches are electrically connected respectively to two of the data lines having the pulse transitions. The control terminals of the first switch and the fourth switch are electrically connected to the first driving line, the control terminals of the second switch and the fifth switch are electrically connected to the second driving line, and the control terminals of the third switch and the sixth switch are electrically connected to the third driving line. Furthermore, the image determiner is configured to determine whether the image displayed by the display panel is a monochromatic image or a complementary color image, and to output a driving signal to one of the driving lines according to a determined result for activating the corresponding switches such that the data lines of the first data line group perform charge sharing therebetween.

In yet another aspect of the embodiment, a method for driving a display panel is provided. The display panel comprises a plurality of pixels, a plurality of data lines and a driving device. Furthermore, each of the pixels comprises a plurality of sub-pixels, and the sub-pixels are disposed in a sub-pixel matrix. The data lines are electrically connected to the sub-pixels respectively. Moreover, the driving device comprises a data driver and a plurality of switches. The data driver outputs data signals to the data lines of a first data line group respectively, and the switches are electrically connected between the data lines. The method for driving the display panel comprises the steps of:

when the display panel displays the image, transferring a plurality of data signals by the data lines of the first data line group, in which the data lines of the first data line group have a plurality of pulse transitions and the switches are disposed between the data lines of the first data line group;

determining the image displayed by the display panel and outputting a driving signal according to a determined result; and activating the corresponding switches according to the driving signal such that the data lines of the first data line group perform charge sharing therebetween.

As a result, the embodiments provide a driving device, a display device and a method for driving a display panel, which address the problem of increased power consumption of an LCD display due to the pulse transition phenomenon by disposing a switch between the data lines having a plurality of pulse transitions such that the data lines can perform charge sharing therebetween. Hence, an improvement is realized with respect to the problem of increased power consumption due to the pulse transitions, and ultimately, the overall power consumption of the display panel is decreased by about 50%.

BRIEF DESCRIPTION OF THE DRAWINGS

The invention can be more fully understood by reading the following detailed description of the embodiments, with reference made to the accompanying drawings as follows.

DETAILED DESCRIPTION

Figure 1:
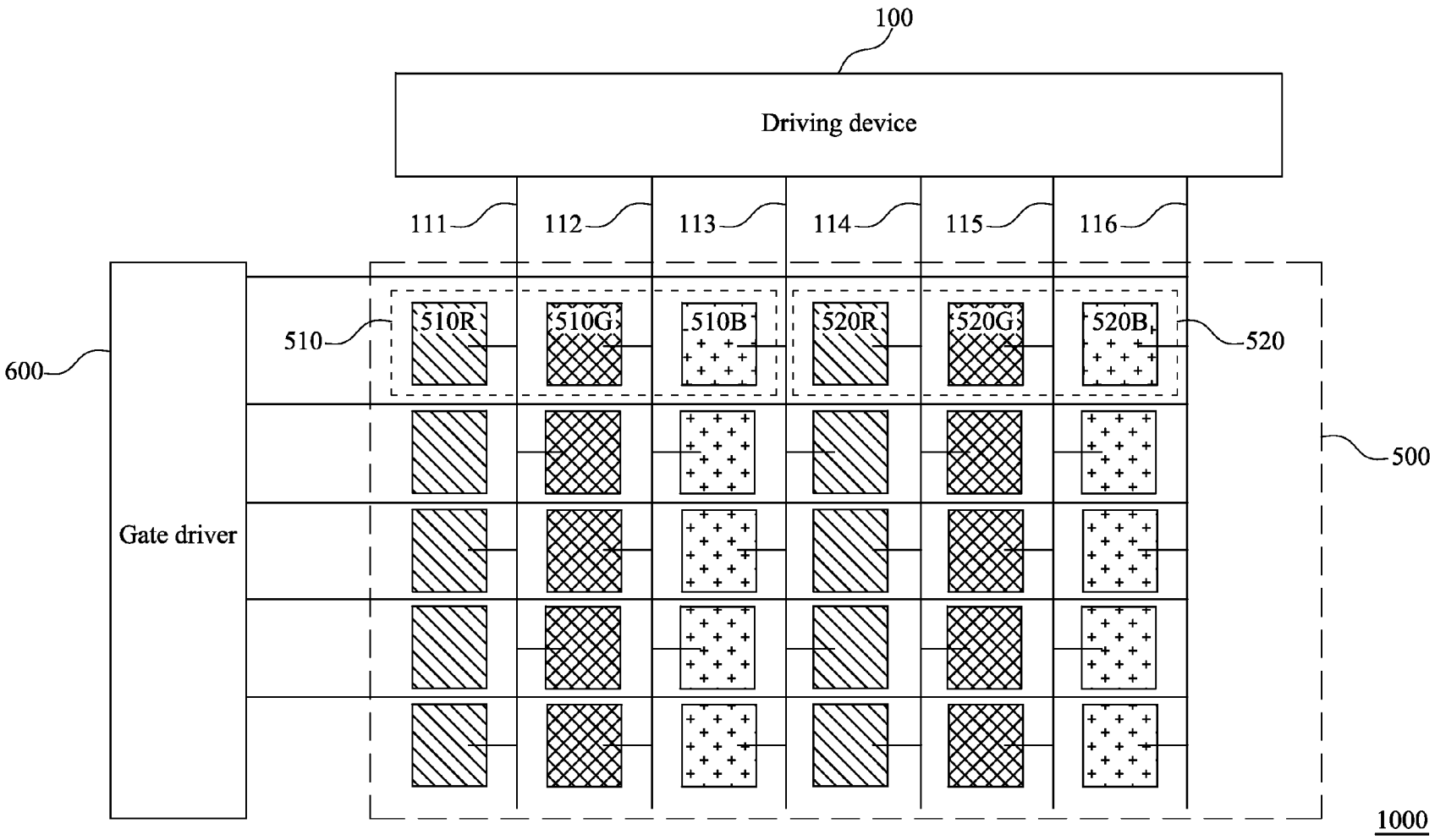
FIG. 1 schematically shows a diagram of a display device according to embodiments of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a," "an," and "the" includes plural reference unless the context clearly dictates otherwise. Also, as used in the description herein and throughout the claims that follow, the meaning of "in" includes "in" and "on" unless the context clearly dictates otherwise.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. The use of examples anywhere in this specification, including examples of any terms discussed herein, is illustrative only, and in no way limits the scope and meaning of the invention or of any exemplified term. Likewise, the invention is not limited to various embodiments given in this specification.

As used herein, "around," "about" or "approximately" shall generally mean within 20 percent, preferably within 10 percent, and more preferably within 5 percent of a given value or range. Numerical quantities given herein are approximate, meaning that the term "around," "about" or "approximately" can be inferred if not expressly stated.

As used herein, the terms "comprising," "including," "having," "containing," "involving," and the like are to be understood to be open-ended, i.e., to mean including but not limited to.

For solving the problem of the increased power consumption of an LCD display due to the pulse transition phenomenon, embodiments provide a driving device, a display device and a method for driving a display panel, and a description regarding the devices and method is disclosed hereinafter with reference to the drawings.

FIG. 1 schematically shows a diagram of a display device according to embodiments of the present invention. As shown in the Figure, the display device 1000 comprises a driving device 100, a gate driver 600, and a display panel 500. Furthermore, the display panel 500 comprises a plurality of pixels 510, 520, etc. and a plurality of data lines 111~116, wherein the pixel 510 comprises sub-pixels 510R, 510G, 510B, the pixel 520 comprises sub-pixels 520R, 520G, 520B, and so on. The sub-pixels are disposed in a sub-pixel matrix. The data lines 111~116 are electrically connected to corresponding sub-pixels 510R, 510G, 510B, 520R, 520G, 520B respectively. However, the scope of the embodiment of the present invention is not intended to be limited in this regard, and this configuration is merely used to describe one implementation of the present invention.

With respect to the operation of the display device 1000, the driving device 100 is configured (or namely operable) to drive the display panel 500 for improving the problem existing in the related art. The driving device 100 will be described in detail below so as to make the technical features of the present invention easier to understand.

Figure 2A:
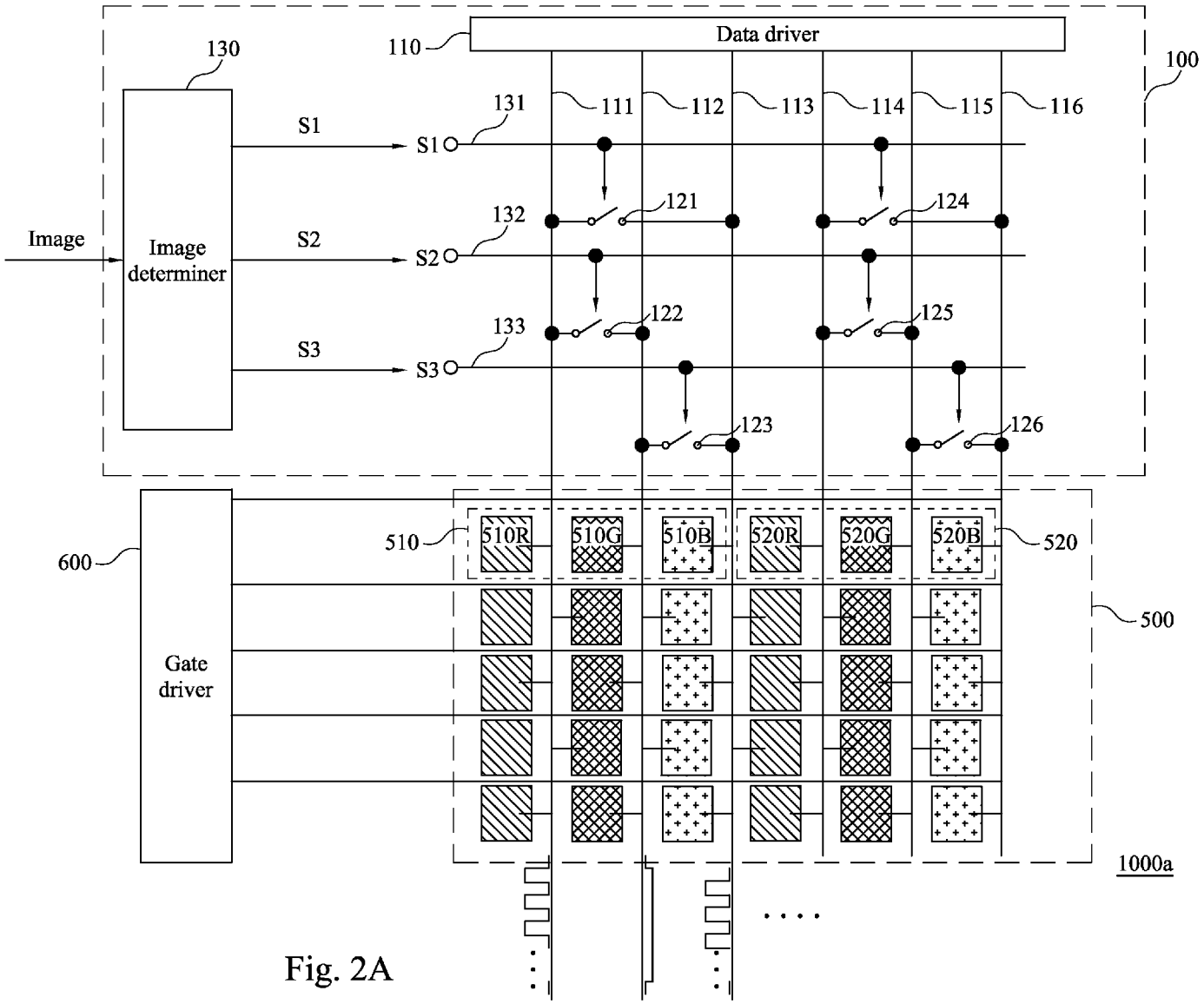
FIG. 2A schematically shows a diagram of the display device of FIG. 1 according to embodiments of the present invention.

FIG. 2A schematically shows a diagram of the display device of FIG. 1 according to embodiments of the present invention. As shown in FIG. 2A, the driving device 100 comprises a data driver 110, a plurality of switches 121~126, and an image determiner 130. The data lines 111~116 are electrically connected to the data driver 110 for receiving data signals D1~D6 outputted by the data driver 110 respectively. The gate driver 600 is electrically connected to a plurality of gate lines (or namely scan lines, is not signed in the figures), and the gate lines are electrically connected to the sub-pixels respectively, and the gate lines for transferring a plurality of scan signals (or namely gate signals, is not marked in the figures) outputted by the gate driver 600 to the sub-pixels respectively. Driving lines 131~133 are electrically connected to the image determiner 130 for transferring driving signals S1, S2, S3 outputted by the image determiner 130.

When the display device 1000*a* displays an image, the data signals transferred by a number of the data lines 111~116 generate a plurality of pulse transitions. The data lines that generate pulse transitions are hereinafter referred to as forming a data line group. For example, when the display device 1000*a* displays a red image, the signals transferred by the data lines 111 and 113 have many pulse transitions, and accordingly, the data lines 111 and 113 form a data line group. For reducing the negative influence to the display device 1000*a* which is produced by the pulse transition phenomenon, with respect to structure, the switches are disposed between the data lines forming each data line group. For example, the switch 121 is electrically connected between the data lines 111 and 113, the switch 122 is electrically connected between the data lines 111 and 112, the switch 123 is electrically connected to the data lines 112 and 113, the switch 124 is electrically connected to the data lines 114 and 116, the switch 125 is electrically connected to the data lines 114 and 115, and the switch 126 is electrically connected to the data lines 115 and 116.

For example, the switch 121 is disposed between the data lines 111, 113 forming the first data line group, and the image determiner 130 is operable to determine the image which the display device 1000*a* intends to display and output a driving signal according to the result of this determination. If the image determiner 130 determines that the image which the display device to 1000*a* wants to display is a red image, the image determiner 130 outputs a driving signal S1 to the switch 121. Subsequently, the switch 121 is activated such that the data lines 111, 113 of the first data line group perform charge sharing therebetween. Hence, the negative influence to the display device 1000*a* which is produced by the pulse transition phenomenon can be reduced. A specific example in this regard will be described below with reference to FIG. 2B.

It is noted that the arrangement of the switches according to various embodiments of the present invention is not limited to the specific arrangement depicted in FIG. 2A. Accordingly, persons having ordinary skill in the art, in view of the spirit of the embodiments, may arrange the switches between the data lines such that at least some data lines carry out charge sharing, and these arrangements are within the scope of the present invention.

In practice, the display panel 500 may be any kind of liquid crystal display (LCD) panel, light-emitting diode (LED)-backlit LCD panel, organic light-emitting diode (OLED) display panel, plasma display panel (PDP), etc., but the present invention is not limited in this regard. Further, each of the switches may be a bipolar junction transistor (BJT), metal-oxide-semiconductor field-effect transistor (MOSFET), insulated gate bipolar transistor (IGBT), etc., but the present invention is not limited in this regard. Persons having ordinary skill in the art may select suitable elements to carry out the present invention based on practical needs.

Figure 2B:
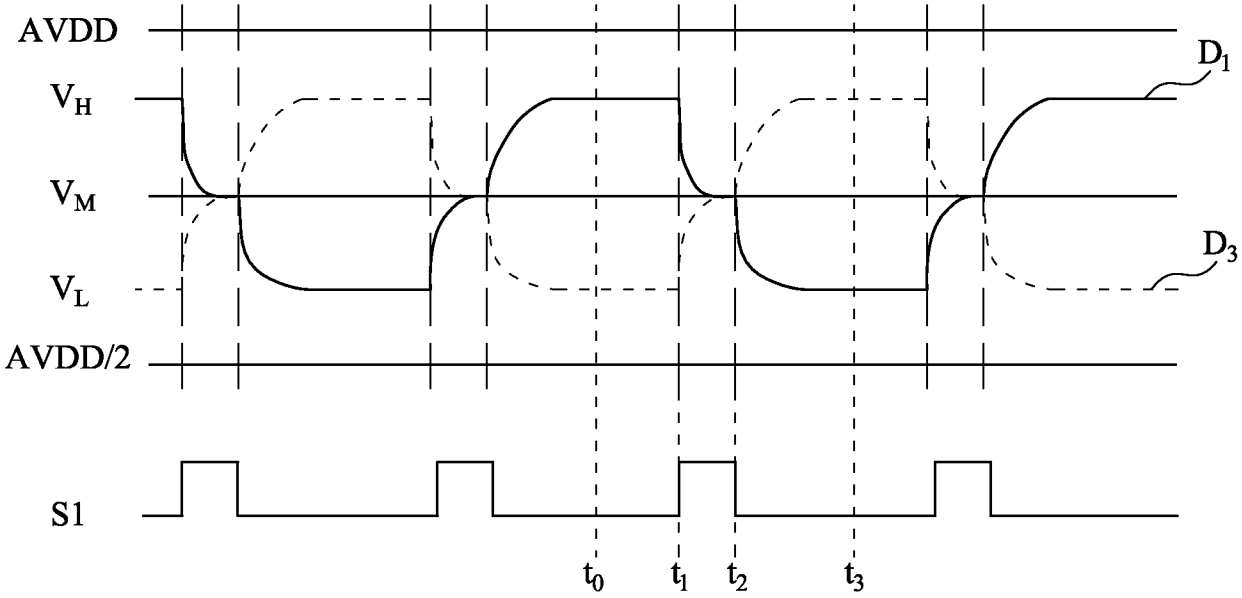
FIG. 2B schematically shows a time chart of a data signal and a driving signal of FIG. 2A according to embodiments of the present invention.

FIG. 2B is provided to elaborate on the operating method of the display device 1000 of FIG. 2A. FIG. 2B schematically shows a time chart of a data signal and a driving signal of FIG. 2A according to embodiments of the present invention.

For example, when the display device 1000*a* displays a pure red image, the image determiner 130 outputs a driving signal S1; when the display device 1000*a* displays a pure green image, the image determiner 130 outputs a driving signal S2; and when the display device 1000*a* displays a pure blue image, the image determiner 130 outputs a driving signal S3, so as to activate the corresponding switch in each of these situations. In one example, the display panel 500 displays a pure red image. As depicted in FIG. 2A and FIG. 2B, when the red sub-pixel (e.g., sub-pixel 510R) is activated while the green sub-pixel (e.g., sub-pixel 510G) and blue sub-pixel (e.g., sub-pixel 510B) are turned off, the data signals transferred between the data lines 111, 113 of the first data line group have a plurality of pulse transitions. Hence, when the display device 1000*a* displays a pure red image, the pulse transitions result in an increase in the power consumption of the display device 1000*a*, as compared to when displaying white or black images which would not result in pulse transitions.

The embodiments aim to address the problem of an increase in power consumption of an LCD resulting from pulse transitions. In certain embodiments, a switch 121 is disposed between the data line 111 and the data line 113 that result in pulse transitions, and an image determiner 130 is used to determine the image that the image display device 1000*a* intends to display. In this way, when the display device 1000*a* displays a pure red image, the voltage level between the data lines is elevated by charge sharing to a sharing voltage level that is higher than the voltage level before such charge sharing, thereby shortening the charging time and reducing power consumption.

For example, when display device 1000*a* intends to display a pure red image, the data line 111 and data line 113 generate pulse transitions (or transfer pulse transition signals), and the image determiner 130 outputs a driving signal S1 to activate the corresponding switch 121. At this time, as illustrated in FIG. 2B, charge sharing is performed between the data line 111 and the data line 113, and the voltage level of the data signals D1 and D3 transferred by the data line 111 and the data line 113 is VM.

Originally, the data signal D3 is charged from the voltage level VL to the voltage level VH during the period from t0 to t3. However, in this case, since the driving signal S1 is enabled at time t1 to activate the switch 121 for performing charge sharing between the data line 111 and the data line 113, the voltage level of the data signal D3 is VM. Therefore, the data signal D3 is charged from the voltage level VM to the voltage level VH during the period from t0 to t3. In this way, the overall power consumption resulting from pulse transitions is reduced by about 50%. In one embodiment of the present disclosure, the data signal D1 provided by the data line 111 and the data signal to D3 provided by the data line 113 have a half-cycle difference.

In one embodiment of the present invention, during the period of pulse transitions (e.g., from the t0 to t3 period), the image determiner 130 activates a plurality of corresponding switches from among the switches 121~126. For example, when the display device 1000*a* displays a pure red image, the switch 121 and the switch 124 are activated; when the display device 1000*a* displays a pure green image, the switch 122 and switch 125 are activated; when the display device 1000*a* displays a pure blue image, the switch 123 and switch 126 are activated. However, the present invention is not limited to the above-mentioned method which only serves as an example of the embodiment of the present invention and facilitates the understanding of the present invention.

In a further embodiment of the present invention as exemplified in FIG. 2A, the sub-pixel matrix is disposed in (or namely arranged in) a zigzag pattern (or namely zigzag structure, or zigzag). Specifically, the data line 111 is electrically connected to the first, third, and fifth sub-pixels in the column formed starting with the sub-pixel 510R and electrically connected to the second and fourth sub-pixels in the column starting with the sub-pixel 510G. In other words, in the same column, the data line 111 is electrically connected to every other sub-pixel, and hence, the overall configuration of the data line 111, the sub-pixel 510R and the sub-pixel 510G are in a zigzag pattern. Further, the to driving device 100 is a column inversion type; however, the present invention is not limited thereto, and persons having ordinary skill in the art may select a suitable configuration to practice the present invention.

Figure 3A:
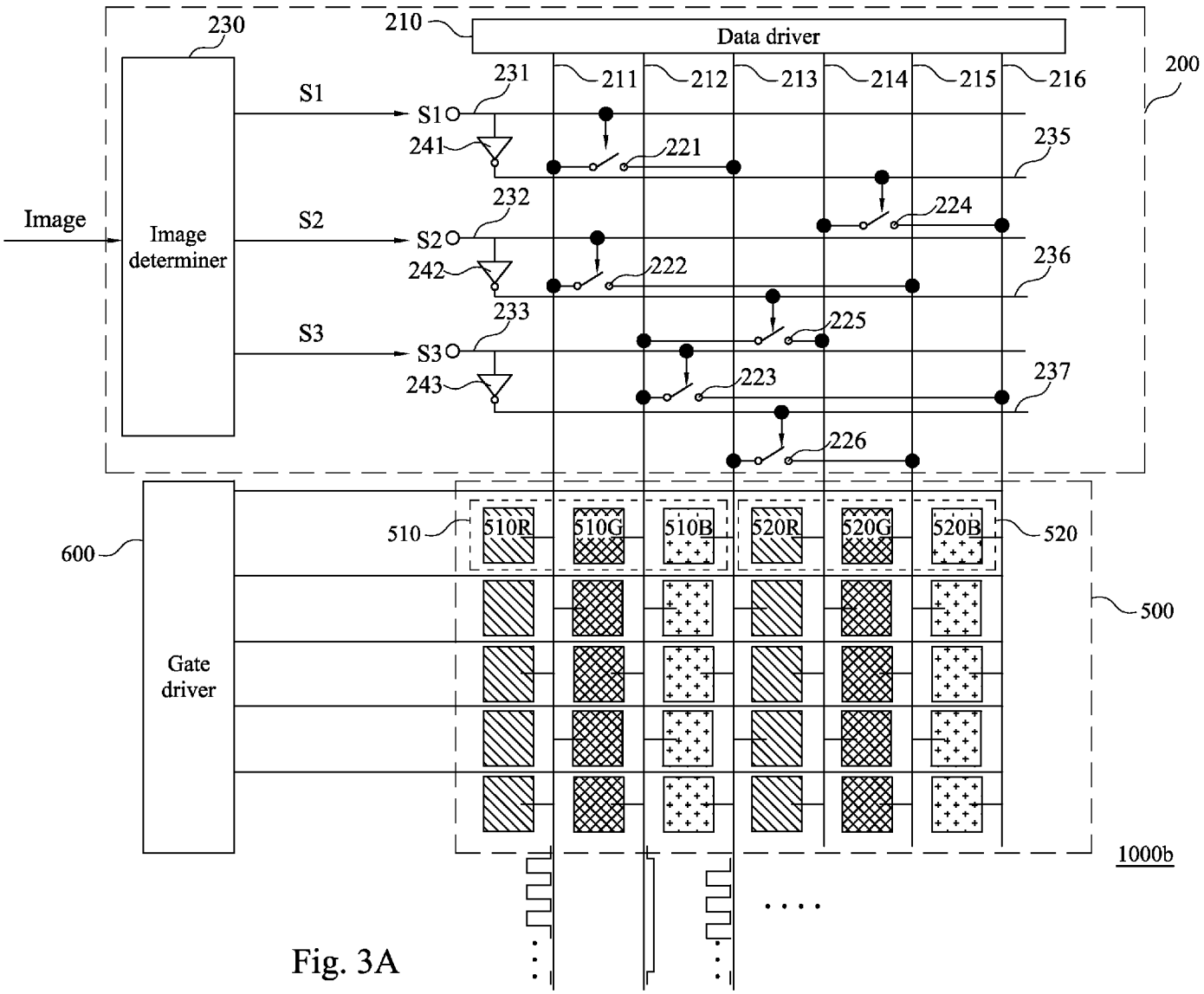
FIG. 3A schematically shows a diagram of the display device of FIG. 1 according to embodiments of the present invention.

FIG. 3A schematically shows a diagram of the display device of FIG. 1 according to embodiments of the present invention. As shown in the FIG. 3, the display device 1000*b* comprises a display panel 500 and a driving device 200. Furthermore, the display panel 500 comprises a plurality of pixels 510, 520, etc., and data lines 211~216. The pixel 510 comprises a plurality of sub-pixels 510R, 510G, and 5108. The pixel 520 comprises a plurality of sub-pixels 520R, 520G, and 520B. The data lines 211~216 are sequentially disposed and electrically connected to corresponding sub-pixels 510R, 510G, 5108, 520R, 520G, and 520B, respectively. Driving lines 231~233 are sequentially disposed.

Moreover, the driving device 200 comprises a data driver 210, driving lines 231~233, switches 221~226 and an image determiner 230. Furthermore, each of the switches 221~226 comprises a first terminal, a second terminal and a control terminal.

It should be noted that in FIG. 3A, elements with the same or a corresponding numeral with those in FIG. 2A operate in the same way, and hence a detailed description with respect to these elements is omitted. As compared with FIG. 2A, the device in FIG. 3A further comprises a number of technical features. In particular, the control terminals of the switch 221 and the switch 224, the control terminals of the switch 222 and the switch 225, and the control terminals of the switch 223 and the switch 226 are electrically connected to the driving lines 231~233, respectively. Further, the driving device 200 further comprises inverter units 241, 242, and 243, and driving lines 235, 236, and 237.

In addition, the first terminal and the second terminal of the switch 221 are electrically connected to the data lines 211 and 213, respectively; the first terminal and the second terminal of the switch 222 are electrically connected to the data lines 211 and 215, respectively; the first terminal and the second terminal of the switch 223 are electrically connected to the data lines 212 and 216, respectively; the first terminal and the second terminal of the switch 224 are electrically connected to the data lines 214 and 216, respectively; the first terminal and the second terminal of the switch 225 are electrically connected to the data lines 212 and 214, respectively; and the first terminal and the second terminal of the switch 226 are electrically connected to the data lines 213 and 215, respectively.

Moreover, the image determiner 230 is further configured to determine whether the image is a complementary color image, and output the driving signal to one of the driving lines based on the result of this determination, so as to activate the corresponding switches 221~226, such that charge sharing is carried out among the data lines of the first data line group.

For example, when the display device 1000*b* displays a mixed color image of green and blue, the image determiner 130 outputs a driving signal S1; when the display device 1000*b* displays a mixed color image of red and blue, the image determiner 130 outputs a driving signal S2; and when the display device 1000*b* displays a mixed color image of red and green, the image determiner 130 outputs a driving signal S3, so as to activate the corresponding switch.

Here, an example is directed to a mixed color image of red and green. In this case, when the red sub-pixel (e.g., sub-pixel 510R) and green sub-pixel (e.g., sub-pixel 510G) are activated while the blue sub-pixel (e.g., sub-pixel 510B) is turned off, the data signals transferred between the data line 212 and the data line 213, and between the data line 215 and the data line 216 have a plurality of pulse transitions. Hence, when the display device 1000*b* displays a mixed color image of red and green, the data lines which generate pulse transitions are the same as the data lines that generate pulse transitions when displaying an image of pure red. Therefore, the switches are controlled in the same way as described above with respect to the display of an image of pure red. The next two examples describe the manner in which control is performed when displaying the other pure colors and mixed colors by the display device 1000*b*.

In the first example, when the image determiner 230 determines that the image is a pure green image or a mixed color image of red and blue, a plurality of pulse transitions are formed between the data line 211 and the data line 215, and between the data line 212 and the data line 214, and based on the result of this determination, the image determiner 230 outputs the driving signal S2 to the second driving line 232 so as to activate the second switch 222 and fifth switch 225.

In the second example, when the image determiner 230 determines that the image is a pure blue image or a mixed color image of red and green, a plurality of pulse transitions are formed between the data line 212 and the data line 216, and between the data line 213 and the data line 215, and based on the result of this determination, the image determiner 230 outputs the driving signal S3 to the third driving line 233 so as to activate the third switch 223 and sixth switch 226. Therefore, when the display device 1000*b* displays the above-mentioned mixed color images, the pulse transitions result in an increase in power consumption of the display device 1000*b*, as compared to when displaying white or black images which would not result in pulse transitions.

The embodiments aim to address problem of an increase in power consumption of an LCD resulting from pulse transitions. In certain embodiments, a switch 221 is disposed between the data line 211 and the data line 213 that result in pulse transitions, and an image determiner 230 is used to determine the image that the image display device 500 intends to display. In this way, when the display device 1000*b* displays a mixed color image of green and blue, the voltage level between the data lines is elevated by charge sharing to a sharing voltage level that is higher than the voltage level before such charge sharing, thereby shortening the charging time and reducing power consumption.

It is noted that the arrangement of the switches according to various embodiments of the present invention is not limited to the specific arrangement depicted in FIG. 3A. Accordingly, persons having ordinary skill in the art, in view of the spirit of embodiments of the present invention, may arrange the switches between the data lines such that at least some data lines carry out charge sharing, and these arrangements are within the scope of the present invention.

Figure 3B:
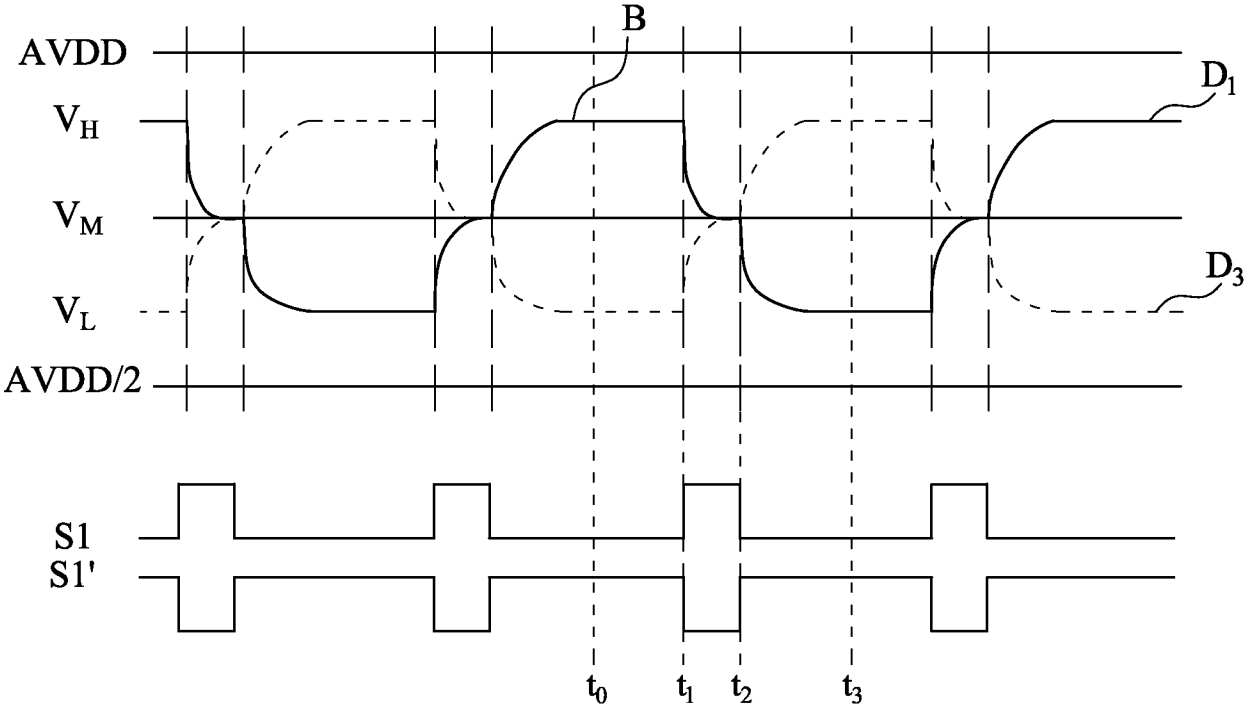
FIG. 3B schematically shows a time chart of a data signal and a driving signal of FIG. 3A according to embodiments of the present invention.

FIG. 3B is provided to elaborate on the operating method of the display device 200 of FIG. 3A. FIG. 3B schematically shows a time chart of a data signal and a driving signal of FIG. 3A according to embodiments of the present invention.

For example, when the display device 1000*b* is used to display a mixed color image of green and blue, the data line 211 and the data line 213 generate pulse transitions (or transfer pulse transition signals), and the image determiner 230 outputs a driving signal S1 to activate the corresponding switch 221. In this case, as illustrated in FIG. 3B, since charge sharing is carried out between the data line 211 and the data line 213, the voltage level of the data signals D1 and D3 transferred by the data line 211 and the data line 213 is VM.

Originally, the data signal D3 is charged from the voltage level VL to the voltage level VH during the period from t0 to t3. However, in this case, since the driving signal S1 is enabled at time t1 to activate the switch 221 for performing charge sharing between the data line 211 and the data line 213, the voltage level of the data signal D3 is VM. Therefore, the data signal D3 is charged from the voltage level VM to the voltage level VH during the period from t0 to t3. In this way, the overall power consumption resulting from pulse transitions is reduced by about 50%.

In one embodiment of the present invention, since the driving device 200 is a column inversion type, the data signal comprises the positive polarity data signal and negative polarity data signal, the first switch is electrically connected between the data lines that transfer the positive polarity data signal and has pulse transitions, and the second switch is electrically connected between the data lines that transfer the negative polarity data signal and has pulse transitions.

Referring to FIG. 3A, for example, when data signals transferred by the data lines 211, 213 and 215 are positive polarity data signals, and data signals transferred by the data lines 212, 214 and 216 are negative polarity data signals, the first switches are the switch 221, the switch 222 and the switch 226, while the second switches are switch 223, the switch 224 and the switch 225.

In another embodiment of the present disclosure, the driving line 231 is electrically connected to the control terminal of the first switch 221, the driving line 231 is electrically connected to the driving line 235 through the inverter unit 241, and the driving line 235 is electrically connected to the control terminal of to the second switch 224. Moreover, control terminals of the switches 224, 225, 226 are electrically connected to the driving lines 231, 232, 233 through their respective inverter units 241, 242, 243.

In operation, at time t1, the image determiner 230 outputs a high level signal to the N-type MOSFET to activate the N-type MOSFET. At the same time, the high level signal output by the image determiner 230 is converted to a low level signal by the inverter unit and transferred to the P-type MOSFET to activate the P-type MOSFET. For example, at time t1, the image determiner 230 outputs a high level signal to the first switch 221 to activate the first switch 221, and at the same time, a high level signal output by the image determiner 230 is converted to a low level signal by the inverter unit 241 and transferred to the first switch 224 to activate the first switch 224.

In this way, since embodiments of the present invention further dispose the switches at the data lines that would generate pulse transitions and between the data lines having the same polarity (not shown), operation errors resulting from the different polarities when performing charge sharing may be avoided. Hence, the overall power consumption of the display panel 500 resulting from pulse transitions is reduced by about 75%.

In another embodiment of the present disclosure (not shown), the switches 224, 225, 226 of FIG. 3A may be N-type MOSFETs, the control terminals of the switches 224, 225, 226 are respectively electrically connected to the driving to lines 231, 232, 233, and there is no need to dispose an inverter unit between the image determiner 230 and the switches 224, 225, 226.

Referring to FIG. 2A, in one embodiment of the present invention, the first terminal and the second terminal of the switch 121 are respectively electrically connected to the data line 111 and the data line 113, and the first terminal and the second terminal of the switch 124 are respectively electrically connected to the data line 114 and the data line 116. When the image determiner 130 determines that the image is a pure red image or a mixed color image of green and blue, the image determiner 130 outputs a driving signal S1 to the driving line 131 based on this determination result so as to activate the switch 121 and the switch 124.

Similarly, in another embodiment of the present disclosure, the first terminal and the second terminal of the switch 122 are respectively electrically connected to the data line 111 and the data line 112, and the first terminal and the second terminal of the switch 125 are respectively electrically connected to the data line 114 and the data line 115. When the image determiner 130 determines that the image is a pure green image or mixed color image of red and blue, the image determiner 130 outputs a driving signal S2 to the driving line 132 based on this determination result so as to activate the switch 122 and the switch 125.

In yet another embodiment of the present disclosure, the first terminal and the second terminal of the switch 123 are respectively electrically connected to the data line 112 and the data line 113, and the first terminal and the second terminal of the switch 126 are respectively electrically connected to the data line 115 and the data line 116. When the image determiner 130 determines that the image is a pure blue image or a mixed color image of red and green, the image determiner 130 outputs a driving signal S3 to the driving line 133 based on this determination result so as to activate the switch 123 and the switch 126.

Figure 4:
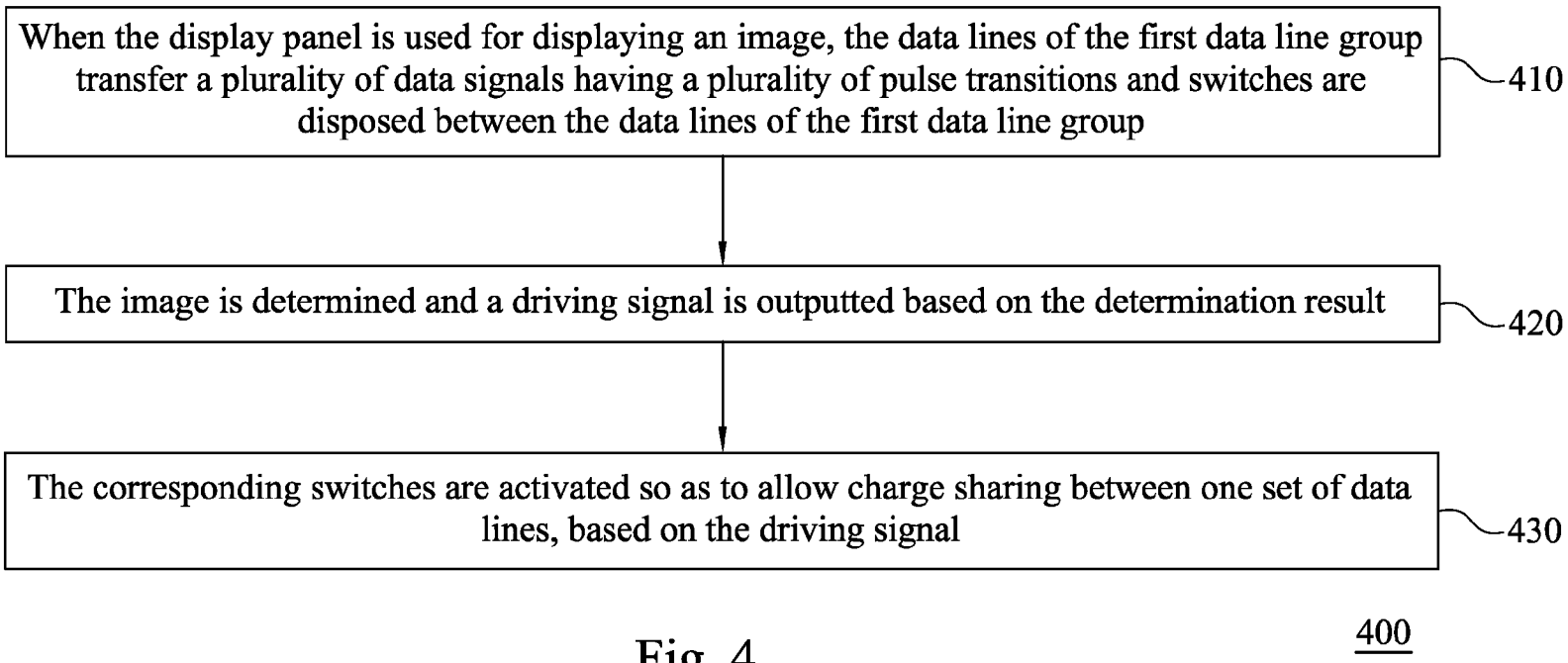
FIG. 4 schematically shows a flow diagram of a method for driving a display panel according to embodiments of the present invention.

FIG. 4 schematically shows a flow diagram of a method for driving a display panel according to embodiments of the present invention. To facilitate the understanding of the present method for driving a display panel, the following description is directed to both FIG. 4 and FIG. 2A to discuss the method steps. Since the driving method is used to drive the display panel 500 of FIG. 2A, a description of the internal structure of the display panel 500 is omitted herein for the sake of brevity.

The method 400 for driving a display panel comprises the steps as follows:

in step 410, when the display panel is used for displaying an image, the data lines of the first data line group transfer a plurality of data signals having a plurality of pulse transitions, and switches are disposed between the data lines of the first data line group;

in Step 420, the image is determined and a driving signal is outputted based on the determination result; and in Step 430, the corresponding switches are activated so as to allow charge sharing between one set of data lines, based on the driving signal.

In step 410, according to one embodiment, the display device 500 displays a pure red image, and when the red sub-pixel is activated and the green sub-pixel and blue sub-pixel are turned off, the data signals transferred between the data lines of the first data line group (i.e., the data lines 111, 113) have a plurality of pulse transitions. Hence, when the display panel 500 displays a pure red image, the pulse transitions result in an increase in the power consumption of the display panel 500, as compared to when displaying white or black images which would not result in pulse transitions.

The embodiments aim to address the problem of an increase in power consumption of an LCD resulting from pulse transitions. With this aim in mind and with reference still to step 410, in certain embodiments, a switch 121 is disposed between the data line 111 and the data line 113 that result in pulse transitions. Further, in step 420, an image determiner 130 is used to determine the image that the image display panel 500 intends to display, and when the display panel 500 intends to display a pure red image, the image determiner 130 outputs the driving signal S1. Next, in step 430, the switch 121 is activated according to the driving signal S1. In this case, since the voltage level between the data line 111 and the data line 113 is elevated by charge sharing to a sharing voltage level that is higher than the voltage level before such charge sharing, the charging time is shortened and power consumption is reduced.

For example, when the display panel 500 intends to display a pure red image, the data line 111 and the data line 113 generate pulse transitions (or transfer pulse transition signals), and the image determiner 130 outputs the driving signal S1 to activate the corresponding switch 121. In this case, as illustrated in FIG. 2B, since charge sharing is carried out between the data line 111 and the data line 113, the voltage level of the data signals D1 and D3 transferred by the data line 111 and the data line 113 is VM.

Conventionally, during time t0 to t3, the data signal D3 should be charged from the voltage level VL to the voltage level VH. However, since the driving signal S1 is enabled at time t1 to activate the switch 121, charge sharing between the data line 111 and the data line 113 results to elevate the voltage level of the data signal D1 to VM. Therefore, the data signal D3 is charged from the voltage level VM to the voltage level VH during the period from t0 to t3. In this way, the overall power consumption of an LCD resulting from pulse transitions of is reduced by 50%

In one embodiment of the present invention, during the period of pulse transitions (such as the above-mentioned t0 to t3), the image determiner 130 is used to activate corresponding switches 121~126. For example, when the display panel 500 displays a pure red image, the switch 121 and the switch 124 are activated, when the display panel 500 displays a pure green image, the switch 122 and switch 125 are activated, and when display panel 500 displays a pure blue image, the switch 123 and the switch 126 are activated. However, to the present invention is not limited to the above-mentioned examples which only serve to illustratively describe the embodiments to facilitate the understanding of the present disclosure.

Here, reference is made to FIG. 3A and FIG. 4. In yet another embodiment of the present disclosure, the data signals comprise positive polarity data signals and negative polarity data signals. The method 400 for driving a display panel comprises, during the period of pulse transitions, activating the switches that electrically connected between the data lines for transferring positive polarity data signals. In this step, with reference to FIG. 3A, for example, when the data signals transferred by the data lines 211, 213 and 215 are positive polarity data signals, the switches between the data lines for transferring the positive polarity data signals are the switch 221, the switch 222 and the switch 226.

In yet another embodiment of the present disclosure, the method 400 for driving a display panel comprises, during the period of pulse transitions, activating the switches that electrically connected between the data lines for transferring negative polarity data signals. In this step, with reference to FIG. 3A, for example, when the data signals transferred by the data lines 212, 214 and 216 are negative polarity data signals, the switches between the data lines for transferring the negative polarity data signals are the switch 223, the switch 225 and the switch 225.

Those having skill in the art will appreciate that the method 400 for driving the display panel can be performed with software, hardware, and/or firmware. For example, if an implementer determines that speed and accuracy are paramount, the implementer may opt for a mainly hardware and/or firmware implementation; alternatively, if flexibility is paramount, the implementer may opt for a mainly software implementation; or, yet again alternatively, the implementer may opt for some combination of hardware, software, and/or firmware. Those skilled in the art will recognize that optical aspects of implementations will typically employ optically oriented hardware, software, and or firmware.

In addition, those skilled in the art will appreciate that each of the steps of the method 400 for driving the display panel named after the function thereof is merely used to describe the technology in the embodiment of the present invention in detail, but the method 400 is not limited in this regard. Therefore, combining the steps of said method into one step, dividing the steps into several steps, or rearranging the order of the steps is within the scope of the embodiment in the present invention.

In view of the foregoing embodiments of the present invention, many advantages of the present invention are now apparent. The embodiments provide a driving device, a display device and a method for driving a display panel, which address the problem of increased power consumption of an LCD display due to the pulse transition phenomenon by disposing a switch between the data lines having a plurality of pulse transitions such that the data lines can perform charge sharing therebetween. Hence, an improvement is realized with respect to the problem of increased power consumption due to pulse transitions, and ultimately, the overall power consumption of the display panel is decreased by about 50%.

In addition, the embodiment of the present invention further provides switches disposed between data lines having the same polarity. Therefore, operation errors resulting from the different polarities when performing charge sharing may be avoided. Hence, the overall power consumption of the display panel 500 resulting from pulse transitions is reduced by about 75%.

It will be understood that the above description of embodiments is given by way of example only and that various modifications may be made by those with ordinary skill in the art. The above specification, examples and data provide a complete description of the structure and use of exemplary embodiments of the invention. Although various embodiments of the invention have been described above with a certain degree of particularity, or with reference to one or more individual embodiments, those with ordinary skill in the art could make numerous alterations to the disclosed embodiments without departing from the spirit or scope of this invention, and the scope thereof is determined by the claims that follow.

What is claimed is:

1. A driving device for driving a display panel, wherein the display panel comprises a plurality of pixels and a plurality of data lines, and each of the pixels comprises a plurality of sub-pixels, wherein the sub-pixels are disposed in a sub-pixel matrix, and the data lines are electrically connected to the sub-pixels respectively, the driving device comprising:

a data driver configured to output a data signal to each of the data lines of a first data line group, wherein the data signals transferred by the data lines of the first data line group have a plurality of pulse transitions when the display panel displays an image;

a plurality of switches electrically connected between the data lines of the first data line group; and an image determiner configured to determine the image displayed by the display panel and to output a driving signal according to a determined result for activating the corresponding switches such that the data lines of the first data line group perform charge sharing therebetween, wherein different switch of the switches is turned on for correspondingly performing charge sharing between different data lines of the first data line group.

2. The driving device according to claim 1, wherein the image determiner activates the switches corresponding to the image during the pulse transition periods.

3. The driving device according to claim 1, wherein when the image determiner determines the image is a monochromatic image, the image determiner outputs the driving signal for activating the switches corresponding to the monochromatic image according to the determined result.

4. The driving device according to claim 1, wherein the data lines of the first data line group comprise a first data line and a second data line, wherein there is half of the period between the data signal provided by the first data line and the data signal provided by the second data line.

5. The driving device according to claim 1, wherein the data signals comprise a positive polarity data signal and a negative polarity data signal, and the switches comprise a first switch and a second switch, wherein the first switch is electrically connected between the data lines which are configured to transfer the positive polarity data signal having pulse transitions, and the second switch is electrically connected between the data lines which are configured to transfer the negative polarity data signal having pulse transitions.

6. The driving device according to claim 5, further comprising:

a first driving line, a second driving line, and an inverter unit, wherein the first driving line is electrically connected to a control terminal of the first switch, the first driving line is electrically connected to the second driving line through the inverter unit, and the second driving line is electrically connected to a control terminal of the second switch.

7. The driving device according to claim 1, wherein two terminals of each of the switches are respectively connected to different data lines in a direct manner.

8. A display device, comprising:

a display panel and a driving device, wherein the display panel comprises a plurality of pixels, a first data line, a second data line, a third data line, a fourth data line, a fifth data line, a sixth data line, and each of the pixels comprises a plurality of sub-pixels, wherein the data lines are disposed sequentially and electrically connected to the sub-pixels respectively, the driving device comprising:

a data driver configured to output a data signal to each of the data lines of a first data line group, and wherein the data signals of the data lines of the first data line group have a plurality of pulse transitions when the display panel displays an image;

a first driving line, a second driving line and a third driving line, and the driving lines are disposed sequentially;

a first switch, a second switch, a third switch, a fourth switch, a fifth switch and a sixth switch, wherein each of the switches comprises a first terminal, a second terminal and a control terminal, and the first terminal and the second terminal of each of the switches are electrically connected respectively to two of the data lines having the pulse transitions, wherein the control terminals of the first switch and the fourth switch are electrically connected to the first driving line, the control terminals of the second switch and the fifth switch are electrically connected to the second driving line, and the control terminals of the third switch and the sixth switch are electrically connected to the third driving line; and an image determiner configured to determine whether the image displayed by the display panel is a monochromatic image or a complementary color image, and to output a driving signal to one of the driving lines according to a determined result for activating the corresponding switches such that the data lines of the first data line group perform charge sharing therebetween.

9. The display device according to claim 8, wherein the first terminal and the second terminal of the first switch are electrically connected to the first data line and the third data line respectively, and the first terminal and the second terminal of the fourth switch are electrically connected to the fourth data line and the sixth data line respectively, wherein the image determiner outputs the driving signal to the first driving line according to the determined result when the image determiner determines that the image is a red image or a color mixture image composed of green and blue for activating the first switch and the fourth switch.

10. The display device according to claim 8 wherein the first terminal and the second terminal of the second switch are electrically connected to the first data line and the second data line respectively, and the first terminal and the second terminal of the fifth switch are electrically connected to the fourth data line and the fifth data line respectively, wherein the image determiner outputs the driving signal to the second driving line according to the determined result when the image determiner determines that the image is a green image or a color mixture image composed of red and blue for activating the second switch and the fifth switch.

11. The display device according to claim 8, wherein the first terminal and the second terminal of the third switch are electrically connected to the second data line and the third data line respectively, and the first terminal and the second terminal of the sixth switch are electrically connected to the fifth data line and the sixth data line respectively, wherein the image determiner outputs the driving signal to the third driving line according to the determined result when the image determiner determines that the image is a blue image or is a color mixture image composed of red and green for activating the third switch and the sixth switch.

12. The display device according to claim 8, wherein the first terminal and the second terminal of the first switch are electrically connected to the first data line and third data line respectively, and the first terminal and the second terminal of the fourth switch are electrically connected to the fourth data line and the sixth data line respectively, wherein the image determiner outputs the driving signal to the first driving line according to the determined result when the image determiner determines that the image is a red image or a color mixture image composed of green and blue for activating the first switch and the fourth switch.

13. The display device according to claim 8, wherein the first terminal and the second terminal of the second switch are electrically connected to the first data line and the fifth data line respectively, and the first terminal and the second terminal of the fifth switch are electrically connected to the second data line and the fourth data line respectively, wherein the image determiner outputs the driving signal to the second driving line according to the determined result when the image determiner determines that the image is a green image or a color mixture image composed of red and blue for activating the second switch and the fifth switch.

14. The display device according to claim 8, wherein the first terminal and the second terminal of the third switch are electrically connected to the second data line and the sixth data line respectively, and the first terminal of the sixth switch is electrically connected to the third data line and the fifth data line, wherein the image determiner outputs the driving signal to the third driving line according to the determined result when the image determiner determines that the image is a blue image or a color mixture image composed of red and green for activating the third switch and the sixth switch.

15. A method for driving a display panel, wherein the display panel comprises a plurality of pixels, a plurality of data lines and a driving device, and each of the pixels comprises a plurality of sub-pixels, wherein the sub-pixels are disposed in a sub-pixel matrix, and the data lines are electrically connected to the sub-pixels respectively, wherein the driving device comprises a data driver and a plurality of switches, the data driver outputs data signals to the data lines of a first data line group respectively, and the switches are electrically connected between the data lines, wherein the method for driving the display panel comprises:

when the display panel displays the image, transferring a plurality of data signals by the data lines of the first data line group, wherein the data lines of the first data line group have a plurality of pulse transitions and the switches are disposed between the data lines of the first data line group;

determining the image displayed by the display panel and outputting a driving signal according to a determined result; and activating the corresponding switches according to the driving signal such that the data lines of the first data line group perform charge sharing therebetween, wherein different switch of the switches is turned on for correspondingly performing charge sharing between different data lines of the first data line group.

16. The method for driving the display panel according to claim 15, wherein the step of activating the corresponding switches is performed during the pulse transition periods.

17. The method for driving the display panel according to claim 15, wherein when the image is determined to be a monochromatic image, the driving signal is outputted for activating the switches corresponding to the monochromatic image according to the determined result.

18. The method for driving the display panel according to claim 15, wherein the data signals comprise a positive polarity data signal and a negative polarity data signal, and the method for driving the display panel comprises:

activating the switch which is electrically connected between the data lines which is configured to transfer the positive polarity data signal during the pulse transition periods.

19. The method for driving the display panel according to claim 18, further comprising:

activating the switch which is electrically connected between the data lines which is configured to transfer the negative polarity data signal during the pulse transition periods.

* * * * *